United States Patent [19]

Robertson

[11] Patent Number: 5,027,446

[45] Date of Patent: Jul. 2, 1991

[54] TOILET SEAT LIFT DEVICE

[76] Inventor: Bruce A. Robertson, 855 Kennedy Road, Suite 702, Scarborough, Ontario, M1K 2E3, Canada

[21] Appl. No.: 575,857

[22] Filed: Aug. 31, 1990

Related U.S. Application Data

[63] Continuation-in-part of Ser. No. 357,029, May 25, 1989, abandoned.

[51] Int. Cl.[5] ..... E03D 11/00

[52] U.S. Cl. ..... 4/254; 297/DIG. 10

[58] Field of Search ..... 4/237, 251, 254, 560, 4/561, 564, 565, 566, 604; 297/DIG. 10

[56] References Cited

U.S. PATENT DOCUMENTS

| | | | |
|---|---|---|---|
| 2,442,303 | 5/1948 | Mayfield | 4/237 |
| 3,060,458 | 10/1962 | Burke | 4/251 X |
| 3,458,872 | 8/1969 | Hellstrom et al. | 4/237 |
| 3,914,806 | 10/1974 | Pearce | 4/254 |
| 3,925,833 | 12/1975 | Hunter | 4/251 |
| 3,958,282 | 5/1976 | Crowe | 4/566 |
| 4,031,576 | 6/1977 | Epstein | 4/251 |
| 4,075,719 | 2/1978 | Sullivan | 4/564 X |
| 4,168,552 | 9/1979 | Austin | 4/237 |
| 4,185,335 | 1/1980 | Alvis | 4/251 |
| 4,510,631 | 4/1985 | Grady | 4/254 X |
| 4,888,833 | 12/1989 | Garcia et al. | 4/251 X |
| 4,993,085 | 2/1991 | Gibbons | 4/251 |

FOREIGN PATENT DOCUMENTS

| | | | |
|---|---|---|---|
| 2434068 | 1/1976 | Fed. Rep. of Germany | 4/564 |
| 658783 | 12/1986 | Switzerland | 4/251 |
| 2058868 | 4/1981 | United Kingdom | 4/251 |
| 2117236 | 10/1983 | United Kingdom | 4/564 |

*Primary Examiner*—Henry J. Recla
*Assistant Examiner*—Robert M. Fetsuga
*Attorney, Agent, or Firm*—Douglas Eggins

[57] ABSTRACT

In a mechanism for raising and lowering disabled persons on a toilet seat the toilet seat is mounted on a carriage which is operated by water-powered cylinders connected to the closet water supply, having the pressure controlled by an adjustable pressure limiting valve and a hand controlled admission valve. The seat is moved vertically throughout its travel to facilitate the user in moving onto and off the seat at their own volition. The cylinders of the mechanism are substantially self-aligning, upon a flexible and laterally adjustable base, having a height adjustment capability, for use with toilets of different heights. The flexible, laterally adjustable base provides adaptation to different width toilets. The toilet seat support platform is pivotally mounted on a supporting carriage as a safety measure, to preclude crushing of anything trapped therebeneath, between the seat platform and the top rim of the toilet bowl, under downward force applied by the double-acting water powered cylinders. The mechanism is highly adaptable, and is held in place by pressure sensitive adhesive securing the base to the floor, independently of the toilet. The mechanism generally accomodates to twisting loads that may be applied by a handicapped user, without incurring binding, and consequent jamming of the mechanism.

20 Claims, 5 Drawing Sheets

TOILET SEAT LIFT DEVICE

This is a continuation-in-part of application Ser. No. 07/357,029, filed May 25, 1989 now abandoned.

FIELD OF THE INVENTION

The present invention relates to water closet seats to enable the use of water closets with greater facility.

The principal object of the present invention is to raise and lower a user and give such user a greater degree of freedom in using water closets than heretofore provided.

BACKGROUND TO THE INVENTION

The perception of providing an adjustable height toilet seat is widely developed, and many types of powered toilet seats are illustrated in existing patents, one of which has, despite certain important drawbacks, been marketed to the public.

The most relevant prior art is considered to be:

U.S. Pat. No. 3,914,806 to Pearce

U.S. Pat. No. 3,925,833 to Hunter,

U.S. Pat. No. 4,587,678 to Love et al.

Further aspects of such devices are found in United States patents:

U.S. Pat. No. 3,458,872, Hedstrom,

U.S. Pat. No. 3,473,174, Cool, October 1969

U.S. Pat. No. 3,594,831, deJong, July 1971

U.S. Pat. No. 3,619,820, Cain et al., Nov. 1971

U.S. Pat. No. 4,031,576, Epstein, June 1977

U.S. Pat. No. 4,168,552, Austin, September 1979

U.S. Pat. No. 4,185,335, Alvis, January 1980

U.S. Pat. No. 4,291,422, Shoemaker,

Certain of the significant drawbacks encountered in the prior art comprise:

the use of electrical power in the dangerous environment of a bathroom, with its inherent vulnerability to short circuits and power failures;

elaborate, space consuming, massive and inflexible arrangements making it difficult or impractical to install;

arrangements employing tilting and re-orientating seats which fail to position the user in an effective, self-supporting position; and, single-acting power lifts relying upon the user's weight to return the seat in a downward direction, which are not convenient for normal use of toilet.

SUMMARY OF THE INVENTION

The present invention provides a system for use in raising and lowering the user thereof, the system utilizing water pressure obtained from a domestic supply. Thus, there is provided an apparatus for bodily raising and lowering a user in predetermined relation to a receptacle such as a toilet, wherein the subject apparatus utilizes a pressurized domestic water supply, generally by way of a selectively adjustable pressure reducing valve.

The presently disclosed system provides a light weight, compact apparatus embodiment adaptable to a variety of local conditions, including a substantially flexible base plate of adjustable size, for positioning about three sides of the base of a toilet, having adhesive floor attachment means to permit ready placement, adjustment, relocation and removal without causing damage to the toilet or to the floor. The equipment generally is free standing, to avoid possible damage to the toilet fixture. The preferred apparatus includes a carriage mounted upon guide columns for displacement therealong, the carriage having side plates with an interconnecting bridge portion extending therebetween. The width of the carriage is selected in accordance with the size of the fixture and the width of base plate adopted. The guide columns are secured in braced, upstanding relation to the base plate. The carriage includes a bearing arrangement slidably mounted on a respective guide column and providing for low friction, non-jamming displacement of the carriage along the guide columns. Extending from the carriage side plates are laterally extending load transfer side portions against which act a pair of hydraulic cylinder assemblies. The cylinder assemblies each have a convexly curved base portion and are located on the base plate by way of a locating pin in combination with a loose fitting retention bracket, permitting movement of the cylinder in self-aligning relation between the base plate and the carriage side plate load transfer portions. Piston members of the cylinder assemblies may be provided with extension pieces to extend their effective length and thereby increase both the height to which the seat carriage can be raised, and the minimum height of the piston assembly, thereby facilitating adaption to various toilet bowl heights.

A seat platform is carried by the seat carriage in forward, horizontally extending relation therefrom. Both seat and platform are pivotally attached, the seat platform to the side plates and the seat to the seat platform, for safety reasons. This precludes crushing of the hands, by downward pressure of the seat platform against the toilet bowl rim.

The seat platform generally is of U-shaped plan form, having a flat upper surface to receive a standard toilet seat in supported relation thereon. The use of a full perimeter seat generally is preferred on account of the complete frontal support area thus provided.

The laterally extending load transfer portion of the carriage side plates are located part way along the seat, at about the centre of gravity of a user when seated upon the seat, such that the load of a user supported in seated relation on the apparatus is transferred substantially directly to the hydraulic cylinder actuators. Stabilizing force moments for off-centre loading conditions, such as when the user sits forwardly or backwardly of the usual position, and during transition of the user from a standing to a semi-supported, and to a fully supported condition, are provided by the carriage slide bearings. In the preferred embodiment each slide bearing assembly comprises a bearing housing integral with the respective carriage side plate, having a pair of plain slide bearings in vertically spaced relation at opposite ends of the bearing housing, to impart optimum load bearing capacity against vertical turning moments produced by off-center loadings, as discussed above. The selection of slide bearings, as opposed to guide wheels minimizes space requirements, and avoids the danger of pinching or crushing hands, particularly of children.

The present invention thus provides a seat and hydraulic apparatus for use in raising and lowering a user in predetermined relation to a receptacle such as a toilet, comprising: a base plate for location in predetermined relation adjacent the receptacle; a pair of spaced apart guide rods extending upwardly in cantilevered supported relation from the base plate, carriage means slidably mounted on the guide rods for passage therealong, the carriage means having a seat platform extending forwardly thereof for attachment of a seat in supported relation thereon; load transfer side portions of the carriage means extending forwardly of the guide rods; extensible hydraulic cylinder means positioned in substantially self-aligning secured relation, one on each side of the apparatus between the base plate and the carriage means load transfer portions; and, non-electrical hydraulic circuit means including a control valve connected with the hydraulic cylinder means for attachment, in use, to a domestic hydraulic supply and powered solely thereby to control the passage of liquid in the system to enable a user to selectively raise and lower the seat platform.

The adoption of long stroke hydraulic actuators with inherent limiting flow rates constitutes a built-in, fail safe safety feature. Thus, the rupture or disconnection of one or more hydraulic hoses in the system will, in a worst-condition scenario, result only in the gradual, controlled descent of one or more of the cylinders, under the weight of the user. This obviates the need for the provision of a safety brake, with its associated additional cost, weight and complexity.

A first embodiment is disclosed having a wall mounted control valve. A second embodiment has an arm-rest mounted control valve.

In one embodiment arm rests are provided, having the control valve and associated coupling hoses located beneath one of the arm rests, with the control lever extending upwardly of the forward end of the arm rest. Interchangeability of the arm rests permits location of the control lever for right handed or left handed users. In the preferred embodiment the arms are secured to the load transfer portions of the carriage.

The provision of removable arm restraint pins, which normally laterally restrain the arms, permits increasing of lateral access to the seat. Thus, withdrawal of a respective arm outer restraint pin permits lateral spreading of the "non-control" arm outwardly, for increased lateral access by a user, or by a helper assisting a user. Correspondingly, withdrawal of an arm inner restraint pin permits inward swinging of that arm in parked, out-of-use relation, over the toilet bowl.

The structure and function of the apparatus according to the invention is such that, in use a handicapped user having difficulty in lowering themselves to a seated position, or in raising themselves to a standing position, for reasons of strength, joint stiffness, etc. are markedly assisted in carrying out the sitting and standing functions.

In order to mount the device the user may raise the platform, together with the toilet seat supported thereon, to a convenient height such that, with legs unbent they can rest their buttocks on the front edge portion of the seat, and as the seat is slowly lowered, transfer their weight progressively rearwardly until they are fully seated. The transfer process, from standing to being supported by the seat is thus effected with the legs straight and the knees of the user in a substantially locked position, where appropriate. The act of dismounting is carried out substantially in reverse.

Experience has shown that the presently disclosed apparatus affords great convenience and assistance to many handicapped users, wherein the height of the toilet seat can be readily adjusted to the optimum for effecting transfer.

The provision of a pair of arm rests is both physically and psychologically supportive to the majority of users. The development of a hydraulic flow control valve with depending connections from its underface was a pre-requisite to the adoption of left arm or right arm controls.

The avoidance of any direct electrical involvement is considered of primary importance, particularly in view of the handicapped condition of many users, the adverse, damp bathroom environment, With high humidity, and the multiple grounding paths provided by the copper piping generally used there, which constitutes an extremely hazardous environment for the operation of electrical apparatus.

Also, in regard to the possibility of electrical power failure, While this is an ever present possibility, the likelihood of a loss in water supply pressure is very much less. This is of great significance as the physical danger to a handicapped person stranded upon a toilet seat is more real than humorous, and permanent crippling effects can result from such prolonged immobilization.

The adoption of modular construction greatly facilitates both installation and servicing of the apparatus.

In addition to its utility for the handicapped, the presently disclosed apparatus imposes little or no restriction on normal use of the toilet by others

BRIEF DESCRIPTION OF THE DRAWINGS

Certain embodiments of the invention are described by way of illustration and without limitation thereto, reference being made to the accompanying drawings, wherein.

DETAILED DESCRIPTION OF THE DRAWINGS

Figure 1:
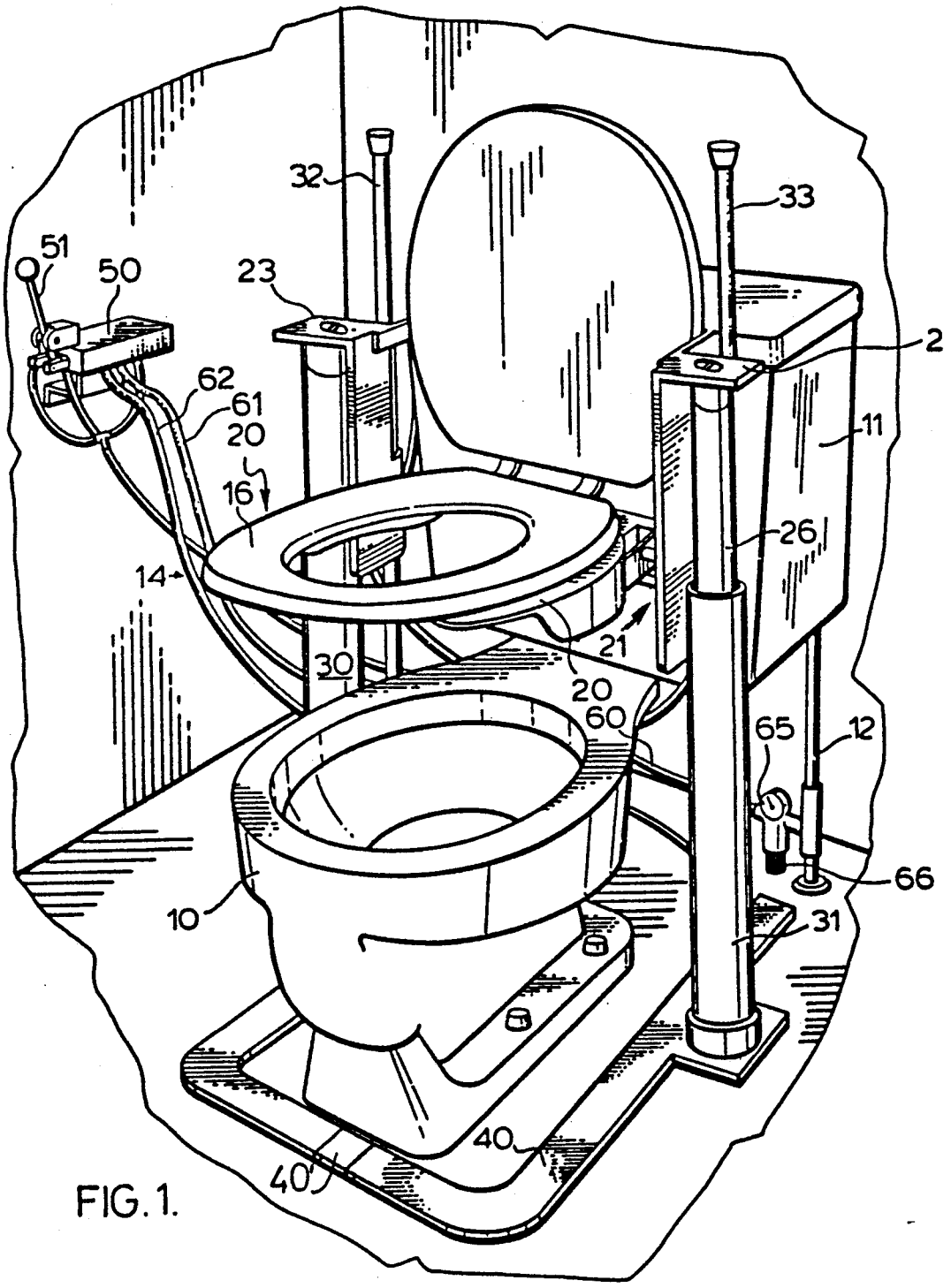
FIG. 1 is a perspective view of a toilet having a seat positioning system in accordance with the present invention shown in relationship to a toilet.
Figure 2:
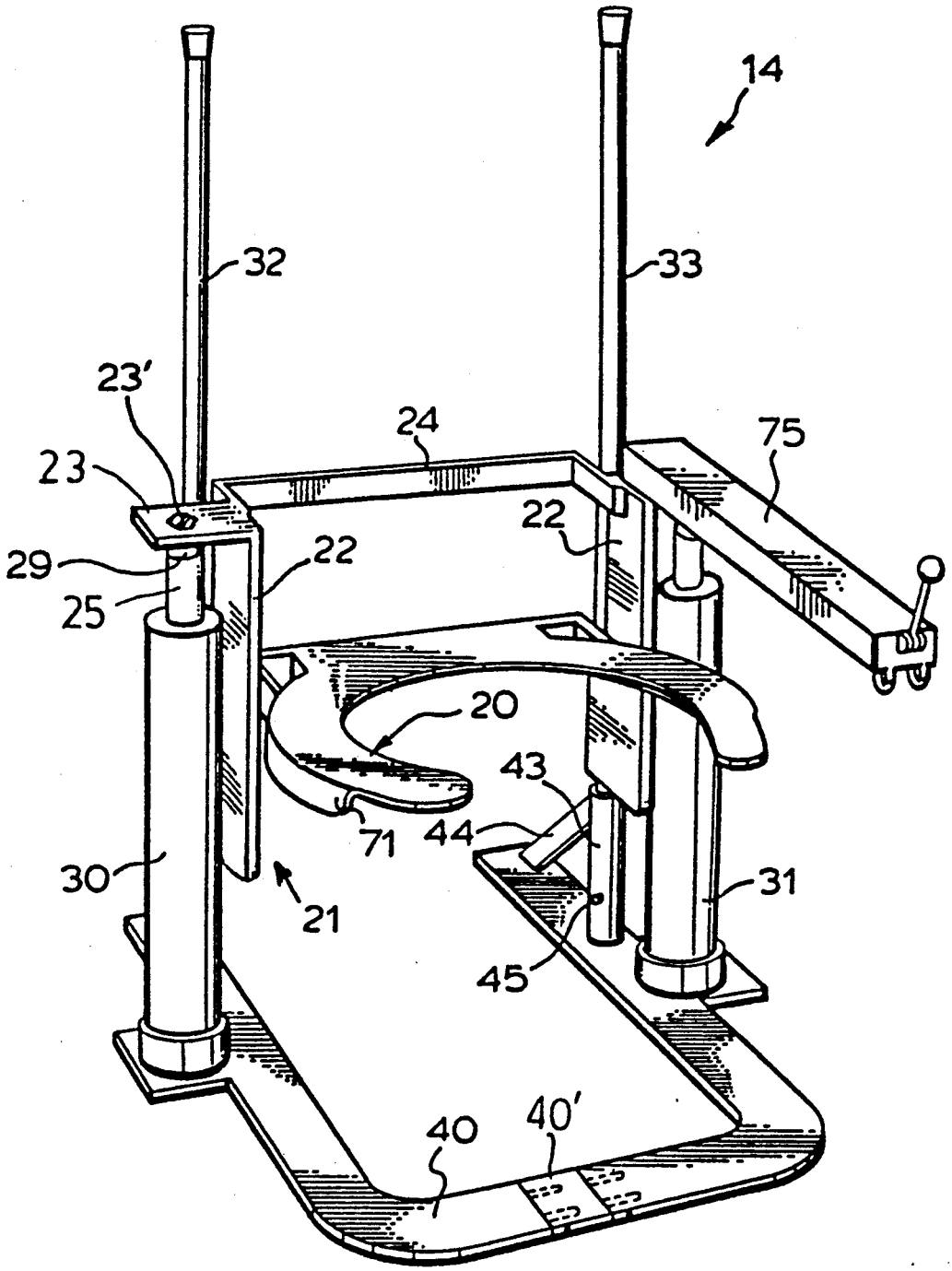
FIG. 2 is a perspective view of the seat positioning apparatus.

Referring to FIGS. 1 and 2 a portion of a bathroom is illustrated, with a toilet bowl 10 and tank 11 having water supply pipe 12 connected therewith, mounted in a corner of the room, in common-place fashion.

A lift seat assembly 14, in accordance with the present invention has a toilet seat 16 of conventional type pivotally mounted on a U-shaped seat platform 20 carried by seat carriage. 21.

The seat carriage 21 has a pair of opposed, vertically extending side plates 22, with horizontally extending upper portions 23, the side plates 22 being interconnected by bridge portion 24. The lateral size of seat carriage 21 is initially selected in accordance with the space available surrounding the toilet, and the size of base plate adopted.

Hydraulic cylinders 30, 31 are mounted upon base plate 40, which is U-shaped, having a removable spacer piece 40' to permit width adjustment to the baseplate 40, in accordance with the lateral size of boWl 10 and the selected width of carriage 21. The spacers 40' may be dowelled in removably secured relation to base plate 40, with releasable set screws engaging the dowells. This permits lateral reduction in the lateral space required by baseplate 40 in locations where space may be particularly restricted.

A number of spacers 40' of different length may be provided, for a range of base plate 40 adjustments, and corresponding carriage widths.

Figure 3:
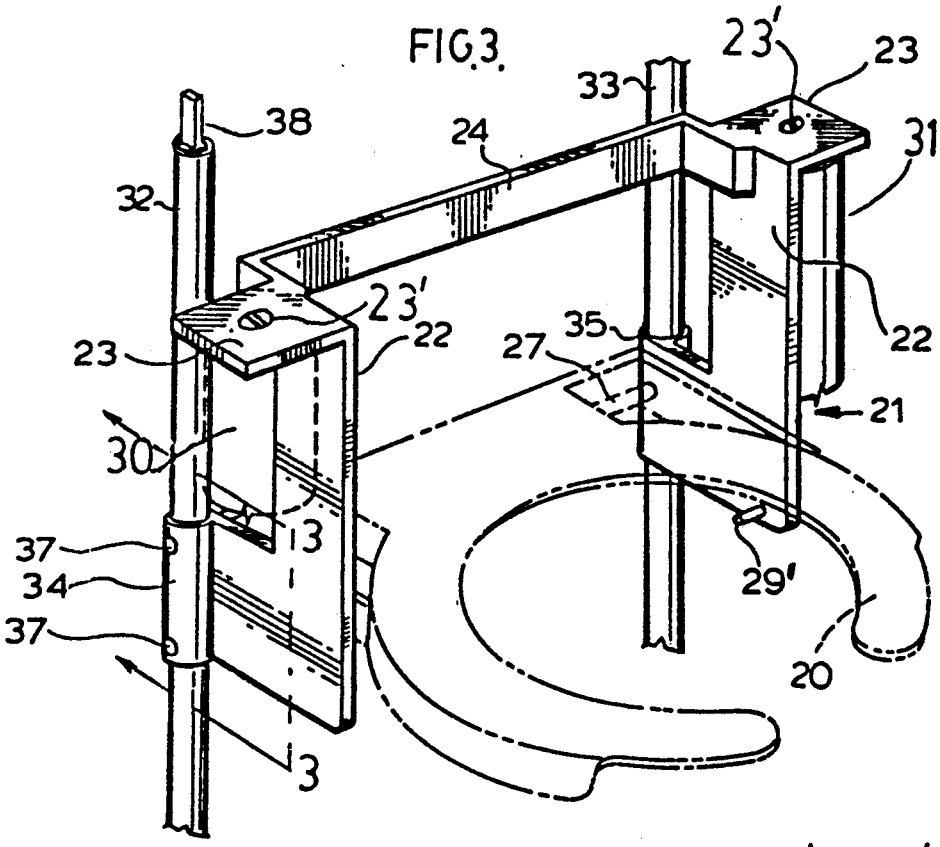
FIG. 3 is an enlarged perspective view of the seat carriage portion and its mounting rods.
Figure 3A:
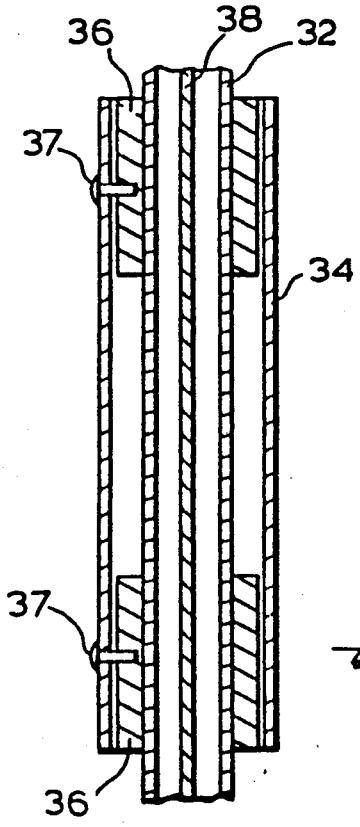
FIG. 3A is a transverse lateral section, in enlarged detail looking in the direction 3—3 of FIG. 3.

Referring also to FIG. 3, cylindrical guide housings 34,35 are connected with and extend rearwardly of the carriage side plates 22, having a pair of guide rods 32,33 extending upwardly therethrough (see also FIG. 3A).

A pair of sockets 43 secured one on each side of base plate 40, with braces 44 and locking screws 45 receive the guide rods 32, 33 in secured, oriented relation therein.

Figure 4:
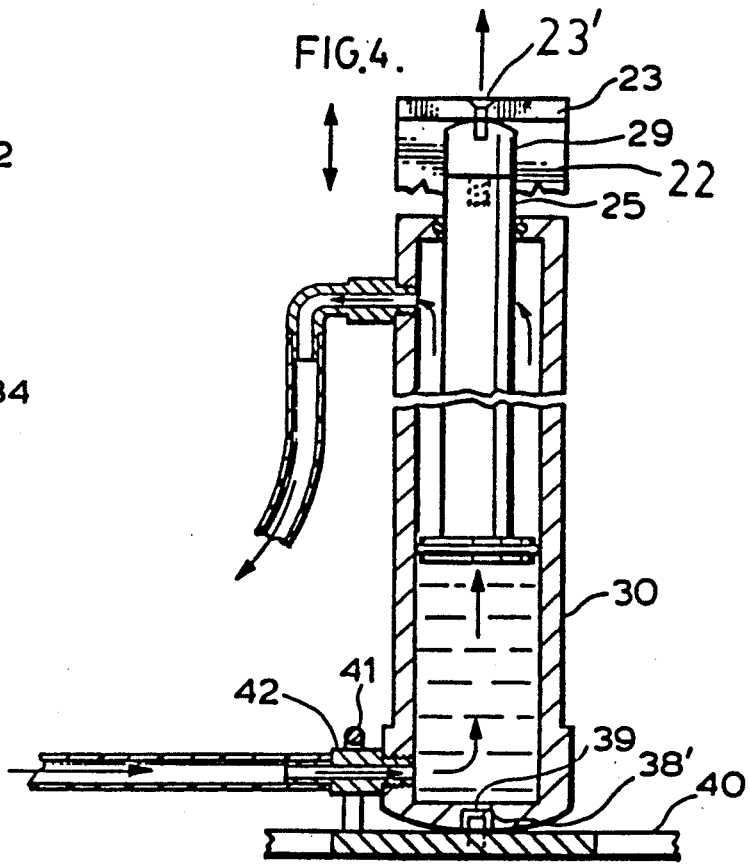
FIG. 4 is a side elevation in diammetrical section of an actuator cylinder and a portion of the carriage.

Referring further to include FIG. 4, piston rod portions 25,26 extending upwardly from cylinders 30,31 have upper portions 29, which may comprise piston rod extension pieces, in load bearing relation with the under surfaces of side plate portions 23. The extension pieces 29 may include a threaded stud lower portion for attachment to the respective rod 25, 26, and a threaded top aperture to receive attachment screws 23'.

Referring more particularly to FIG. 3A, the housing 34 through which the guide rod 32 extends has a pair of slide bearing journals 36 in spaced apart relation therein, being secured by fasteners 37, which permit self-aligning of journals 36. The journals 36 generally comprise low friction graphite-filled nylon bushings, for minimal maintenance and long life.

The guide rods 32,33 have an outer cylindrical shell portion and a diametrical stiffening web 38 secured in a fore and aft oriented direction to provide reinforcement against bending moments exerted on carriage 21 by the user. Such bending moments arise as a consequences of the user sitting out of balance with the piston rods 25,26, and/or applying eccentric loads in transferring their weight to or from the seat, as described above.

Reverting to FIG. 1, a control valve 50 having a removable control lever 51 is illustrated as being wall mounted, being connected by flexible hoses 60, 61, 62, etc. with the water supply line 12, by way of pressures reducing valve 65. The control lever 51 can be fixed or of a type that is readily removable for safety purposes, to preclude tampering or play by unauthorized individuals. The removable type control lever has a slotted lower end, to engage a pin on the control valve spindle.

The adjustable valve 65 has a knurled control handle 66 to facilitate setting the system pressure, in the supply hose 60. The system supply generally is regulated to a pressure sufficient to raise the optimum working load, as represented by the heaviest user of that particular installation, at an adequate rate. The control valve 50 provides an acceptable range of rate variation.

Referring further to FIG. 4, each actuator cylinder 30, 31, has a radiused support surface with a central recess 38' and a centering pin 39. In addition to being in loosely aligned relation by way of the recess 38' and pin 39, each cylinder 30, 31 also is movably secured to base plate 40 by way of an inverted bracket 41 secured to baseplate 40, and located in loose, restraining relation with the respective hydraulic fitting 42.

This arrangement permits a certain extent of working, conforming movement of the cylinders 30, 31, in self-aligning relation between baseplate 40 and respective carriage portions 23, to which the piston head portions 29 are attached by way of screws 23'. This arrangement also facilitates ready disconnection and replacement of the cylinders 30, 31.

Figure 5:
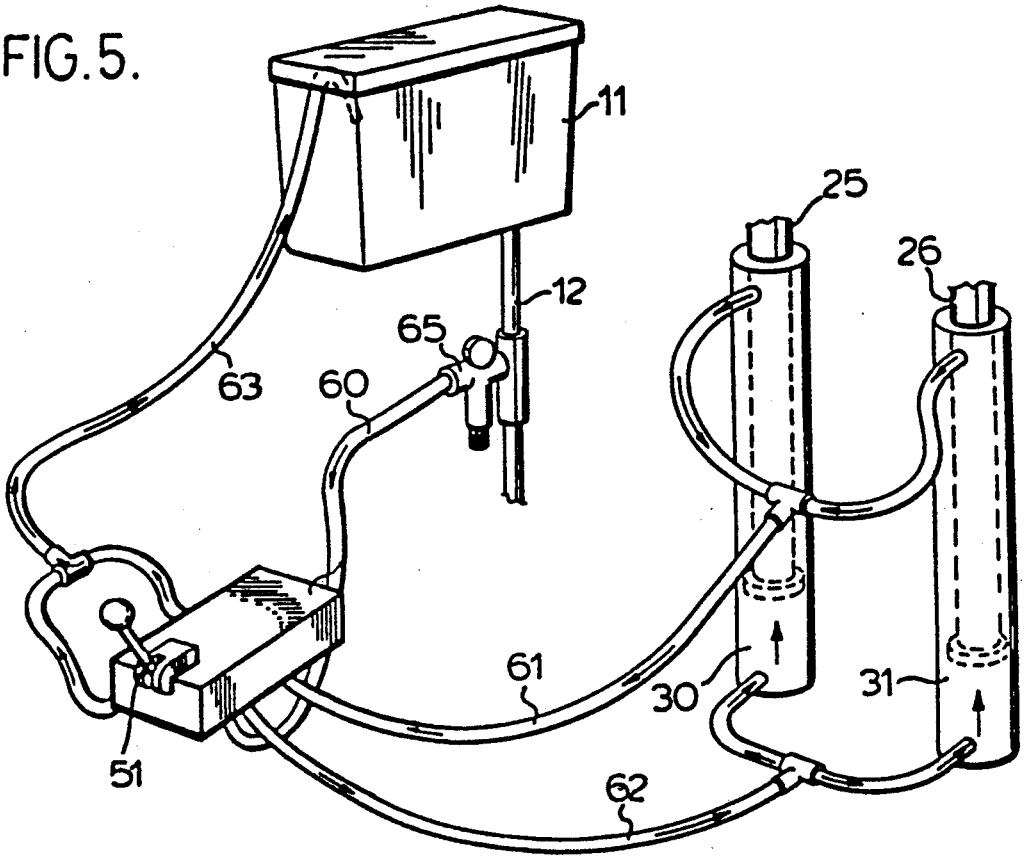
FIGS. 5 and 6 are schematic representations of the hydraulic hose connections, showing directions of water flow for respectively raising and lowering the seat carriage; and, FIG. 7 is a plan view of an embodiment having arm rests and a restraint belt thereon.
Figure 6:
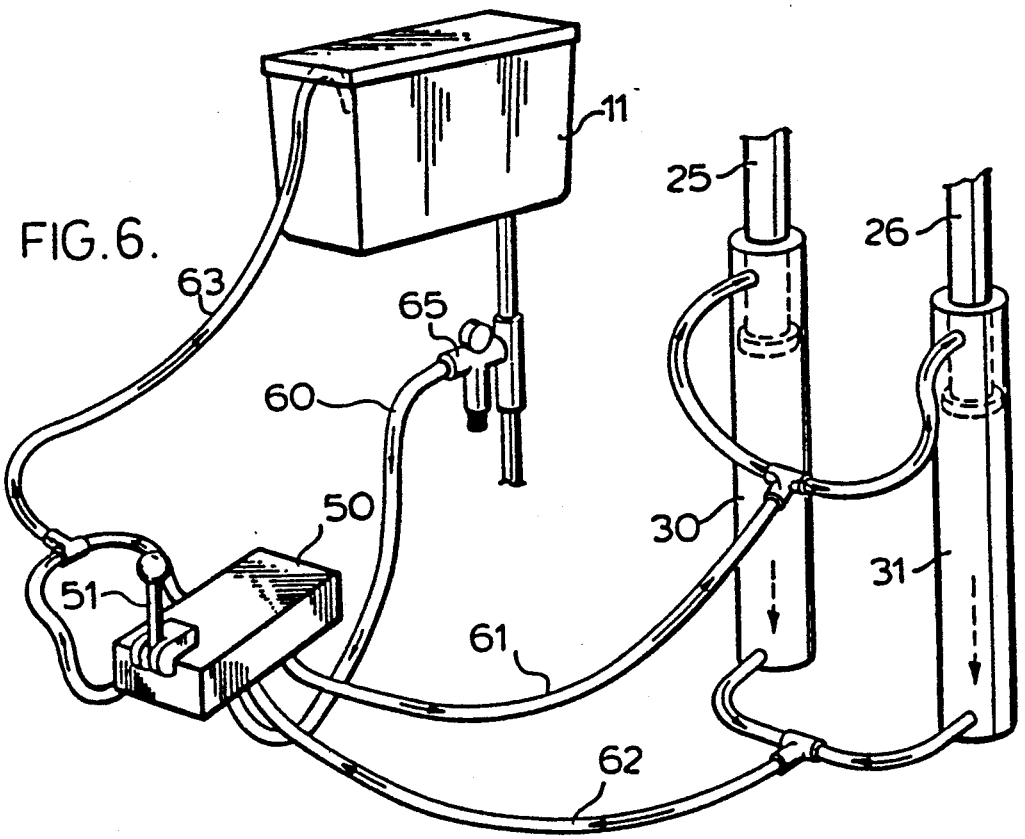

Referring to FIGS. 5 and 6, it will be recognized that the actuators 30,31 are double acting, such that, under control of the 3-way control valve 50, the actuators are shut-off in a hydraulically locked condition or are in a carriage raising condition, or are in a carriage downward displacing condition. This latter, positive downward displacement provision avoids the drawbacks of piston and carriage hold-up, due to friction and provides positive downward displacement of the carriage without reliance on the weight of the user. The carriage platform portion 20 is pivotally mounted by way of platform hinge shaft 27 and supported by platform support pins 29', of which one only is shown in FIG. 3. This safety measure permits upward tilting of the platform if an obstruction is encountered beneath the platform, and thus substantially precludes crushing, of such as a child's hand if playing with the device.

Figure 7:
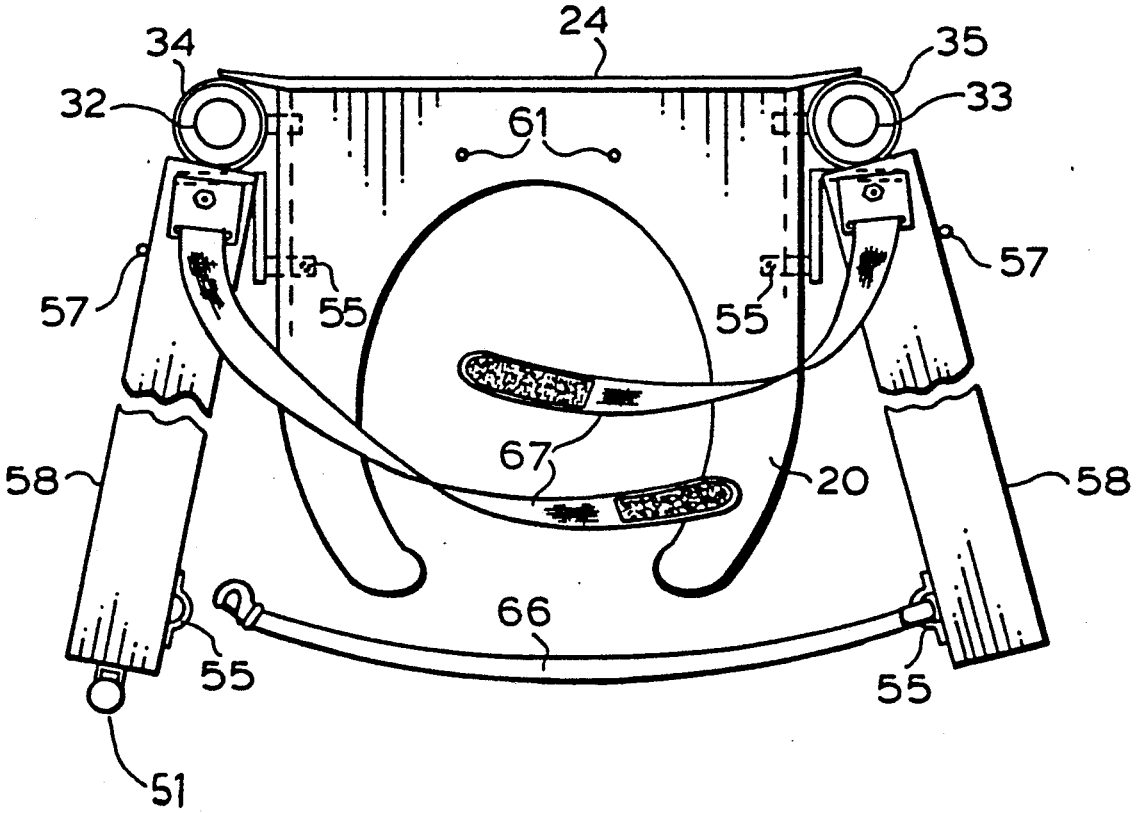

Referring to FIG. 7, the seat carriage components 24, 33, 34 and 35 and seat platform 20 are seen in plan view. A pair of arm rests 58 are illustrated, the left hand arm 58 (as viewed) being the "control arm" and having control lever 51 secured thereto.

A retaining rod 66 is shown, removably clipped at its ends to the arm rests 58 by way of brackets 55. A further restraint strap 67 having hook and loop fasteners of the VELCRO (TM) type may be provided. The rod 66 serves to keep the arms 58 spaced apart.

The retaining rod 66 also serves to retain patients upon the seat, with or without the use of straps 67.

Withdrawable and replaceable restraint pins 57, 57 limit lateral displacement of the related arm components.

In use, by removal of a respective restraint pin 57, the freed arm generally not being the control arm, may be opened out laterally to a wider extent, to enhance lateral access by a user or a helper. This can greatly facilitate transfer of a user to and from a wheel chair.

Apertures 61 serve to receive the mounting bolts (not shown) of the hinges for toilet seat 16.

What is claimed is:

1. A seat support and hydraulic apparatus for use in raising and lowering a user in predetermined relation to a receptacle such as a toilet, comprising:

a base plate for location in predetermined relation adjacent said receptacle;

a pair of spaced apart guide rods extending upwardly in cantilevered supported relation from said base plate, located rearwardly thereof;

carriage means slidably mounted on said guide rods for passage therealong, said carriage means having a seat platform extending forwardly thereof for attachment of a seat in supported relation thereon;

load transfer side portions of said carriage means extending forwardly of said guide rods;

extensible hydraulic cylinder means positioned in self-aligning secured relation between said base plate and said carriage means load transfer portions, one on each side of said apparatus; and non-electrical hydraulic circuit means including a control valve connected with said hydraulic cylinder means, for attachment, in use, to a domestic hydraulic supply and powered solely thereby, to enable a user to selectively raise and lower said seat platform.

2. The apparatus as set forth in claim 1, said hydraulic cylinder means including a rounded base portion in constrained relation with said base plate.

3. The apparatus as set forth in claim 2, said base plate having pin means in substantial centering relation with said cylinder means base portion.

4. The apparatus as set forth in claim 1, said hydraulic cylinder means including attachment means securing said hydraulic cylinder means to said carriage load transfer portions.

5. The apparatus as set forth in claim 1, said base plate having a pair of opposed side portions and a front portion in connecting relation therebetween, said front portion being divided to facilitate the insertion of a spacer in interposed relation therein, to extend the length of said front portion in accommodation with the relative width of a bowl portion of said toilet.

6. The apparatus as set forth in claim 1, said hydraulic cylinder means including removable extension pieces, to extend the length of said cylinder means by a predetermined extent.

7. The apparatus as set forth in claim 1, said guide rods comprising an internally reinforced cylindrical rod.

8. The apparatus as set forth in claim 1, said guide rods each being mounted within an attachment socket secured to said base plate.

9. The apparatus as set forth in claim 8, said guide rods being each secured in a said socket in predetermined oriented relation with said base plate, each said guide rod containing a reinforcement web extending substantially the full length of the rod, the plane of said web being oriented in a pre-determined direction, relative to said carriage means, to resist bending moments applied on said rod by loads acting upon said carriage means.

10. The apparatus as set forth in claim 9, said plane of said web extending fore and aft in a direction from front to rear of said toilet.

11. The apparatus as set forth in claim 1, said hydraulic circuit means further including a pressure reducing valve, to permit operation of the apparatus at pressures commensurate with the weight of a user.

12. The apparatus as set forth in claim 11, said pressure reducing valve being adjustable within a predetermined working pressure range.

13. The apparatus as set forth in claim 1, said carriage means having an arm extending forwardly therefrom, having said hydraulic control valve secured in operable relation thereon.

14. The apparatus as set forth in claim 13, said hydraulic control valve having hose connection ports thereof located on a bottom surface of the valve.

15. The apparatus as set forth in claim 1, said carriage means having a pair of arms extending forwardly therefrom in mutually spaced apart relation, having safety belt attachment means thereon, in use to receive a safety belt in secured relation to secure a user in seated relation between said arms.

16. The apparatus as set forth in claim 1, said seat platform being secured in horizontally oriented, upwardly pivotal relation to said carriage means.

17. The apparatus as set forth in claim 16, including attachment means for securing said seat in attached, upwardly pivotal relation thereto.

18. The apparatus as set forth in claim 1, said seat platform being of U-shaped plan form, having the open bight of the U-shape facing forwardly of said carriage means, in combination with a toilet seat mounted thereon.

19. The apparatus as set forth in claim 1, said base plate including cylinder attachment means for attaching said cylinder in limited movable relation with said base plate.

20. The apparatus as set forth in claim 1, said carriage means having at least one arm extending forwardly therefrom, and arm restraint means to limit lateral displacement of said arm relative to said carriage, and to permit selected predetermined lateral displacement of said arm inwardly and outwardly relative to said carriage means.

* * * * *